US012673800B1

(12) United States Patent
Yu

(10) Patent No.: US 12,673,800 B1
(45) Date of Patent: Jul. 7, 2026

(54) PULL-OUT STORAGE BOX

(71) Applicant: Wenjiao Yu, Fuzhou (CN)

(72) Inventor: Wenjiao Yu, Fuzhou (CN)

( * ) Notice: Subject to any disclaimer, the term of this patent is extended or adjusted under 35 U.S.C. 154(b) by 0 days.

(21) Appl. No.: 19/454,296

(22) Filed: Jan. 20, 2026

(51) Int. Cl.
*B65D 6/06* (2006.01)
*B65D 25/28* (2006.01)

(52) U.S. Cl.
CPC ..... *B65D 11/12* (2013.01); *B65D 25/2808* (2013.01)

(58) Field of Classification Search
CPC .. B65D 11/12; B65D 25/2808; B65D 85/187; B65D 5/38; A47B 88/941; A47B 88/90; A47B 55/00
USPC ..... 220/23.91; 312/330.1, 348.2, 348.1
See application file for complete search history.

(56) References Cited

U.S. PATENT DOCUMENTS

| | | | | |
|---|---|---|---|---|
| 4,988,003 | A * | 1/1991 | Spitzer | A47B 87/0207 220/23.6 |
| 5,199,592 | A | 4/1993 | Reiland et al. | |
| 6,193,340 | B1 * | 2/2001 | Schenker | A47B 47/0075 312/265.5 |
| 7,861,878 | B2 | 1/2011 | Escarpa Gil | |
| 10,118,728 | B2 | 11/2018 | Yamamoto | |
| 10,273,075 | B2 | 4/2019 | Brantley | |
| 11,350,744 | B2 | 6/2022 | Kobayashi | |
| 11,760,535 | B2 | 9/2023 | Dai | |
| 2006/0194483 | A1 | 8/2006 | Escarpa Gil | |
| 2008/0203089 | A1 * | 8/2008 | Hartwall | B65D 19/18 108/55.3 |
| 2011/0304249 | A1 | 12/2011 | Lai | |
| 2012/0223072 | A1 * | 9/2012 | Yamauchi | B65D 11/1873 220/4.01 |
| 2018/0194513 | A1 * | 7/2018 | Yamamoto | A47B 43/00 |
| 2023/0142977 | A1 * | 5/2023 | Dai | B65D 11/26 220/23.87 |
| 2023/0391497 | A1 | 12/2023 | Jian | |

FOREIGN PATENT DOCUMENTS

| | | | |
|---|---|---|---|
| CN | 307629010 | S | 11/2022 |
| CN | 307649564 | S | 11/2022 |
| CN | 307675775 | S | 11/2022 |
| CN | 307722004 | S | 12/2022 |
| DE | 10048750 | A1 | 4/2002 |
| DE | 102004055863 | A1 | 5/2006 |

(Continued)

*Primary Examiner* — Laura E. Parker
(74) *Attorney, Agent, or Firm* — Bayramoglu Law Offices LLC

(57) ABSTRACT

The present disclosure describes a pull-out storage box, comprising a pull-out box and a pull-out frame. The frame consists of an upper plate, a lower plate, and a support beam assembly that includes two side beams and two independently disposed rear beams. Insertion grooves are provided at the left, right, and rear ends of both the upper and lower plates. During assembly, inserting the side beams and rear beams into their respective grooves forms an integrated frame structure, on which the pull-out box is seated and can slide. This configuration establishes a support system that distributes bearing points to both sides and the rear, creating a more uniform spatial load-bearing layout. Consequently, it effectively minimizes overall shaking and deformation of the box, thereby significantly enhancing the structural durability and operational stability of the entire pull-out storage system.

6 Claims, 11 Drawing Sheets

(56) References Cited

FOREIGN PATENT DOCUMENTS

| | | | |
|---|---|---|---|
| ES | 2895645 | T3 | 2/2022 |
| GB | 2039850 | B | 8/1980 |
| JP | 2500274 | Y2 | 6/1996 |
| JP | 3883834 | B2 | 2/2007 |
| JP | 2008127086 | A | 6/2008 |
| JP | 4652037 | B2 | 3/2011 |
| JP | 4717730 | B2 | 7/2011 |
| JP | 4745898 | B2 | 8/2011 |
| JP | 2013233952 | A | 11/2013 |
| JP | 2019069791 | A | 5/2019 |

* cited by examiner

PULL-OUT STORAGE BOX

BACKGROUND

1. Technical Field

The present disclosure relates to the technical field of storage boxes, and in particular, to a pull-out storage box.

2. Background Information

As a commonly used storage device in modern households and office environments, the pull-out storage box is widely favored for its convenient pull-out design and efficient space utilization. The pull-out storage box mainly includes a pull-out box and a pull-out frame, where the pull-out box is used for storing items, typically adopts a box structure with a certain capacity, and is mounted inside the pull-out frame to enable the pull-out function. Conventional pull-out frames mostly adopt an integral wrapping structure. To optimize the material utilization, a frame type pull-out frame is gradually being developed. This frame type pull-out frame typically includes an upper plate, a lower plate, and support beams, which enclose to form a stable frame structure that provides support and guidance for the pull-out box. Generally, the support beams are disposed between the upper plate and the lower plate and distributed on the left and right sides of the frame type pull-out frame, and at least two support beams are disposed on each side to ensure the load-bearing capacity and stability of the overall structure. This arrangement can meet users' daily usage needs to a certain extent. However, with the continuous improvement of users' demands for product durability and user experience, the arrangement of the support beams has gradually exposed its deficiencies. This is specifically manifested in uneven load distribution and limited deformation resistance, leading to easy shaking of the pull-out storage box during frequent pulling or when carrying heavy items, and even structural loosening or deformation, which in turn affects the service life and user experience of the product.

BRIEF SUMMARY

In view of this, the present disclosure provides a pull-out storage box, aiming to overcome the deficiencies in the arrangement of the support beam of the conventional pull-out storage box.

The present disclosure provides a pull-out storage box, including a pull-out box and a pull-out frame, where the pull-out box is of a hollow structure and has an upward opening; the pull-out frame includes an upper plate, a lower plate, and a support beam; the support beam includes two side beams and two rear beams; a left end and a right end of each of the upper plate and the lower plate are oppositely provided with a pair of first insertion grooves, and rear ends of the upper plate and the lower plate are oppositely provided with two pairs of second insertion grooves separated from each other;

when an upper end and a lower end of each of the side beams are respectively inserted into the corresponding pair of first insertion grooves, and an upper end and a lower end of each of the rear beams are respectively inserted into the corresponding pair of second insertion grooves, the pull-out frame forms an integrated frame structure; and the pull-out box is located on the lower plate and capable of sliding into or out of the frame structure.

In a possible embodiment, the pull-out box and the pull-out frame are both of a rectangular structure, the two side beams and the two rear beams have a same structure, planes where the two pairs of first insertion grooves are located are parallel to each other, the two pairs of second insertion grooves are located in a same plane, and the plane where each pair of first insertion grooves is located is orthogonal to the plane where the two pairs of second insertion grooves are located.

In a possible embodiment, two strip-shaped protruding portions are separately disposed on an upper surface of the lower plate along a sliding direction of the pull-out box, a length of the protruding portions is slightly less than a length of the lower plate, and a height of the protruding portions is slightly greater than a height of the lower plate.

In a possible embodiment, mounting positions are respectively disposed at four corners of a lower surface of the lower plate, and a soft gasket is disposed in each of the mounting positions and protrudes from the mounting position.

In a possible embodiment, the mounting positions and the soft gaskets are both of a circular structure.

In a possible embodiment, the pull-out box includes a bottom plate and a side portion, where the bottom plate is of a planar structure, the side portion is of a vertically through structure, and the bottom plate and the side portion are connected by insertion fit and enclose to form an integrated box body with an upward opening.

In a possible embodiment, an edge of the bottom plate is provided with a third insertion groove having an upward opening; a side wall of the third insertion groove protrudes from an upper surface of the bottom plate and is provided with a first wedge member; a spacing between a wedge surface of the first wedge member and the side wall of the third insertion groove increases gradually from top to bottom along a direction away from the third insertion groove, starting from a position connected to the side wall of the third insertion groove; a flat surface of the first wedge member is perpendicular to the side wall of the third insertion groove and connected to a lower part of the wedge surface of the first wedge member; a bottom surface of the side portion is provided with an insertion strip matching the third insertion groove; an upper end of the insertion strip is not flush with a left end and/or a right end of the bottom surface of the side portion, such that at least one of the left end and the right end of the bottom surface of the side portion forms a projecting portion; a position of a side wall of a lower end of the insertion strip corresponding to the first wedge member is provided with a second wedge member; a spacing between a wedge surface of the second wedge member and the side wall of the lower end of the insertion strip increases gradually from bottom to top along a direction away from the insertion strip, starting from a position connected to the insertion strip; a flat surface of the second wedge member is perpendicular to a side wall of the insertion strip and connected to an upper part of the wedge surface of the second wedge member;

when the insertion strip on the side portion is inserted into the third insertion groove from the opening of the third insertion groove in the bottom plate, the wedge surface of the second wedge member slides along the wedge surface of the first wedge member until the flat surface of the second wedge member is limited by the flat surface of the first wedge member; in addition, the projecting portion of the bottom surface of the side portion is blocked by the side wall of the third insertion groove, such that the side portion and the bottom plate closely enclose to form an integrated box body.

In a possible embodiment, the side portion includes a front plate and a rear plate arranged symmetrically front and back, and a left plate and a right plate arranged symmetrically left and right, where front and rear ends of the left plate and the right plate are each provided with a strip-shaped clamping groove, and left and right ends of the front plate and the rear plate are each provided with a strip-shaped clamping strip matching the strip-shaped clamping groove; and when all the strip-shaped clamping strips are inserted into the corresponding strip-shaped clamping grooves from openings of the corresponding strip-shaped clamping grooves, the front plate, the left plate, the rear plate, and the right plate are sequentially connected and enclose to form a vertically through rectangular structure.

In a possible embodiment, a side wall of the strip-shaped clamping groove is provided with a through hole, and a side wall of the strip-shaped clamping strip is provided with a wedge block matching the through hole; and when the strip-shaped clamping strip is inserted into the corresponding strip-shaped clamping groove from the opening of the corresponding strip-shaped clamping groove, the wedge block extends into the through hole and a flat surface of the wedge block is limited by a side edge of the through hole.

In a possible embodiment, the front plate is provided with a handle.

Compared with the prior art, the present disclosure has the following beneficial effects: a pull-out storage box includes a pull-out box and a pull-out frame, where the pull-out box is of a hollow structure and has an upward opening; the pull-out frame includes an upper plate, a lower plate, and a support beam; the support beam includes two side beams and two rear beams; a left end and a right end of each of the upper plate and the lower plate are oppositely provided with a pair of first insertion grooves, and rear ends of the upper plate and the lower plate are oppositely provided with two pairs of second insertion grooves separated from each other; when an upper end and a lower end of each of the side beams are respectively inserted into the corresponding pair of first insertion grooves, and an upper end and a lower end of each of the rear beams are respectively inserted into the corresponding pair of second insertion grooves, the pull-out frame forms an integrated frame structure; and the pull-out box is located on the lower plate and capable of sliding into or out of the frame structure. It can be seen that, in the pull-out storage box, one side beam is disposed on each of a left side and a right side between the upper plate and the lower plate of the pull-out frame, and the two rear beams are independently disposed at a rear end. The side beams mainly provide stable support for the pull-out frame in a left-right direction, thus effectively preventing the pull-out frame from left-right shaking and torsional deformation; and the rear beams stabilize the rear end of the pull-out frame, thus effectively resisting front-rear bending and torsion caused during pulling, and ensuring the rigidity and stability of an overall structure. Compared with the conventional structural layout that relies solely on side support beams, the pull-out frame extends support points from a single side to both sides and the rear end, thereby forming a support system with a more uniform spatial distribution and more comprehensive load-bearing capacity. When the pull-out box is frequently pulled or bears a heavy item, the arrangement of the support beam can effectively reduce the overall shaking and deformation of the pull-out storage box, and enhance the durability and service stability of the overall structure, thereby significantly improving user experience and prolonging product life.

Figure 1:
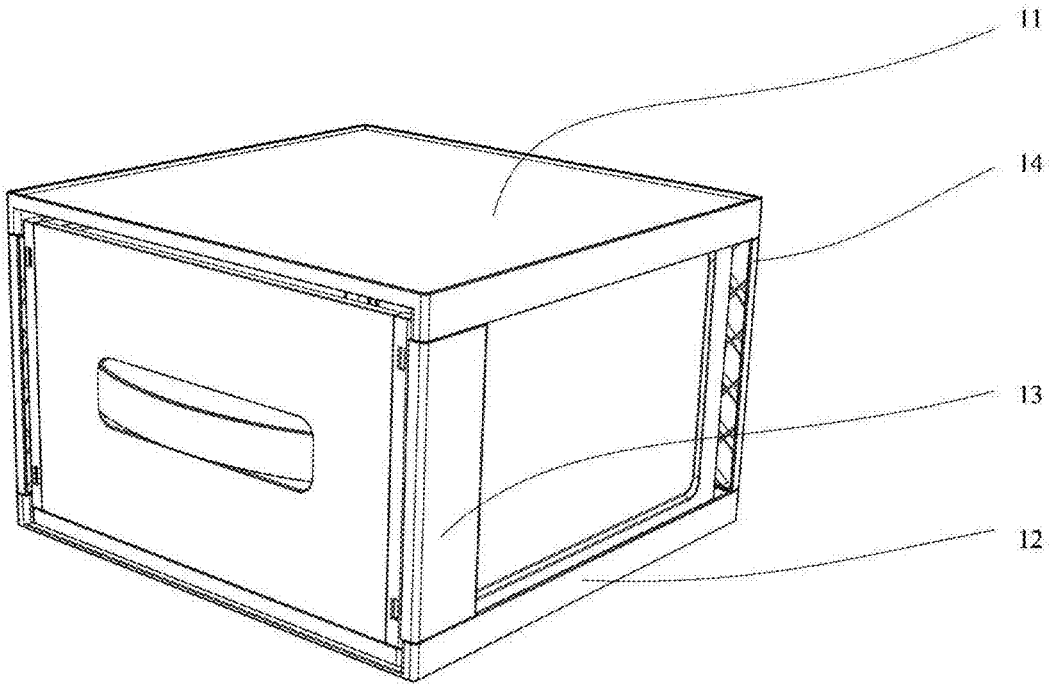
FIG. 1 is a schematic structural diagram of a pull-out box of a pull-out storage box in a slide-in state according to an embodiment of the present disclosure.

Reference numerals are described as follows:

11: upper plate; 12: lower plate; 13: side beam; 14: rear beam; 15: first insertion groove; 16: second insertion groove; 17: protruding portion; 18: soft gasket; 20: bottom plate; 21: third insertion groove; 22: first wedge member; 30: insertion strip; 31: second wedge member; 41: front plate; 42: rear plate; 43: left plate; 44: right plate; 51: strip-shaped clamping strip; 52: strip-shaped clamping groove; 53: through hole; 54: wedge block; and 60: handle.

DETAILED DESCRIPTION OF THE DRAWINGS AND THE PRESENTLY PREFERRED EMBODIMENTS

The technical solutions in the embodiments of the present disclosure will be clearly and completely described below with reference to the accompanying drawings in the embodiments of the present disclosure. Apparently, the described embodiments are merely some rather than all of the embodiments of the present disclosure. All other embodiments obtained by those of ordinary skill in the art based on the embodiments in the present disclosure without creative efforts shall fall within the scope of protection of the present disclosure.

It should be noted that if directional indications (such as up, down, left, right, front, back . . . ) are involved in the embodiments of the present disclosure, such directional indications are only used to explain relative positions, sliding states, etc. of components in a specific pose (as shown in the figure), and if the specific pose changes, the directional indication also changes accordingly.

In addition, if descriptions of the terms such as "first" and "second" are involved in the embodiments of the present disclosure, such descriptions are only for descriptive purposes and should not be understood as indicating or implying relative importance or implicitly specifying the quantity of the indicated technical features. Thus, features defined with "first" and "second" can explicitly or implicitly include at least one of the features. Furthermore, the technical solutions among the various embodiments may be combined with one another, but must be based on the implementation by those of ordinary skill in the art. When the combination of the technical solutions is contradictory or may not be implemented, it should be considered that such combination of the technical solutions does not exist and is not within the scope of protection of the present disclosure.

As shown in FIG. 1, the present disclosure provides a pull-out storage box, including a pull-out box and a pull-out frame, where the pull-out box is of a hollow structure and has an upward opening; the pull-out frame includes an upper plate 11, a lower plate 12, and a support beam; the support beam includes two side beams 13 and two rear beams 14; a left end and a right end of each of the upper plate 11 and the lower plate 12 are oppositely provided with a pair of first insertion grooves 15, and rear ends of the upper plate 11 and the lower plate 12 are oppositely provided with two pairs of second insertion grooves 16 separated from each other;

when an upper end and a lower end of each of the side beams 13 are respectively inserted into the corresponding pair of first insertion grooves 15, and an upper end and a lower end of each of the rear beams 14 are respectively inserted into the corresponding pair of second insertion grooves 16, the pull-out frame forms an integrated frame structure; and the pull-out box is located on the lower plate 12 and capable of sliding into or out of the frame structure.

Specifically, the pull-out frame includes an upper plate 11, a lower plate 12, and a support beam, where the support beam includes two side beams 13 and two rear beams 14. The left end of the upper plate 11 and the left end of the lower plate 12 are oppositely provided with a pair of vertical first insertion grooves 15 for inserting the upper end and the lower end of one side beam 13, and the right end of the upper plate 11 and the right end of the lower plate 12 are oppositely provided with another pair of vertical first insertion grooves 15 for inserting the upper end and the lower end of the other side beam 13. To improve force balance of the structure, the first insertion grooves 15 in the left and right ends of the upper plate 11 can also be arranged oppositely in a transverse direction and positioned near a front end of the upper plate 11, and the first insertion grooves 15 in the left and right ends of the lower plate 12 can also be arranged oppositely in the transverse direction and positioned near a front end of the lower plate 12, so as to coordinate with the two pairs of second insertion grooves 16 in the rear ends. The rear ends of the upper plate 11 and the lower plate 12 are provided with two pairs of second insertion grooves 16 separated from each other and used for inserting the upper and lower ends of the corresponding rear beams 14. These two pairs of second insertion grooves 16 are respectively formed in left and right sides of the rear ends of the upper plate 11 and the lower plate 12, aiming to avoid stress concentration and disperse a load transfer path. They cooperate with the two pairs of first insertion grooves 15 in left and right sides of the front ends. After the corresponding support beam is inserted, the upper plate 11 and the lower plate 12 are jointly supported to form a stable frame structure, thereby effectively distributing the overall force, reducing the risk of structural deformation, and improving the overall stability of the product. The arrangement of the support beam ensures optimal support performance while minimizing the number of support beams, thereby optimizing the material utilization and mechanical properties of the structure.

An outer surface of the support beam is smooth to ensure product aesthetics and user touch feel, and an inner surface thereof is of an inclined grid structure. Through reasonable distribution of inclined cross skeletons, the inclined grid structure can effectively disperse and transfer stress, thereby enhancing the strength and rigidity of the support beam, reducing the overall weight, and achieving an optimal balance between the structural performance and the material utilization. To facilitate smooth insertion of upper and lower ends of the support beam into the corresponding insertion grooves and to avoid protruding after insertion, a cross-sectional dimension of the upper and lower ends of the support beam is slightly smaller than a cross-sectional dimension of a middle segment area and matches a cross-sectional dimension of the insertion grooves. This not only facilitates precise matching and tight connection between the support beam and the corresponding insertion grooves to ensure a stable connection between the two, but also guarantees the flatness and aesthetics of the overall structure. The pull-out frame has a simple overall structure, requires no additional complex connecting members, relies solely on mutual insertion of its own structure to achieve a firm connection, facilitates easy assembly and disassembly, and significantly improves the maintenance convenience of the product.

Compared with the prior art, in the pull-out storage box according to the present disclosure, one side beam 13 is disposed on each of a left side and a right side between the upper plate 11 and the lower plate 12 of the pull-out frame, and the two rear beams 14 are independently disposed at a rear end. The side beams 13 mainly provide stable support for the pull-out frame in a left-right direction, thus effectively preventing the pull-out frame from left-right shaking and torsional deformation; and the rear beams 14 stabilize the rear end of the pull-out frame, thus effectively resisting front-rear bending and torsion caused during pulling, and ensuring the rigidity and stability of an overall structure. Compared with the conventional structural layout that relies solely on side support beams, the pull-out frame extends support points from a single side to both sides and the rear end, thereby forming a support system with a more uniform spatial distribution and more comprehensive load-bearing capacity. When the pull-out box is frequently pulled or bears a heavy item, the arrangement of the support beam can effectively reduce the overall shaking and deformation of the pull-out storage box, and enhance the durability and service stability of the overall structure, thereby significantly improving user experience and prolonging product life.

Figure 2:
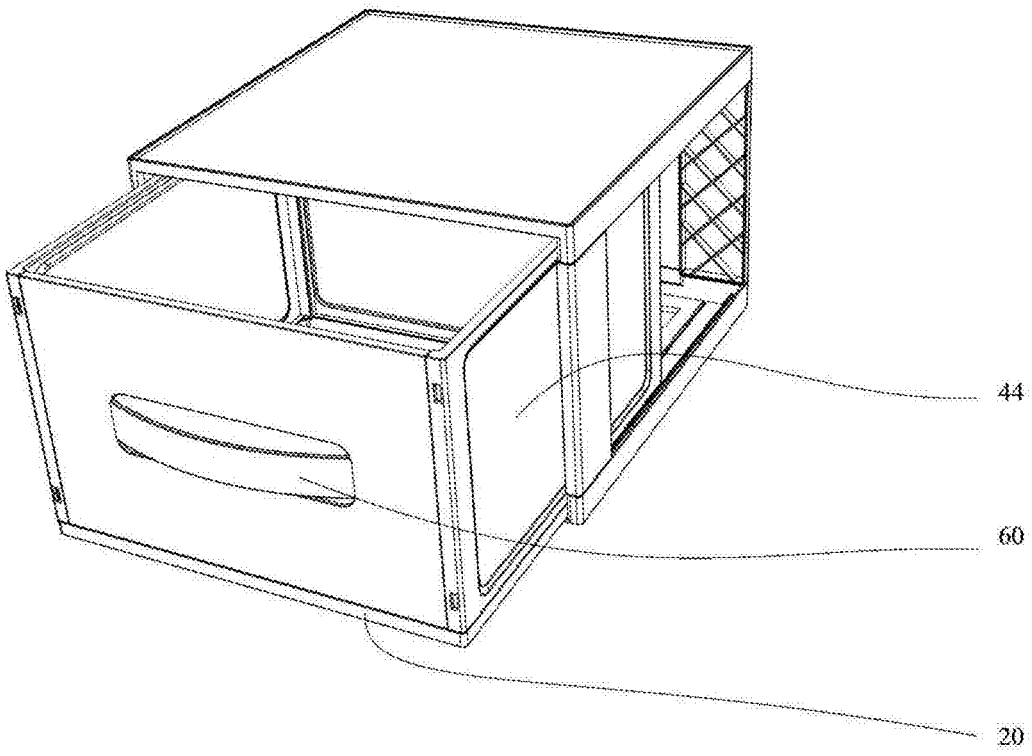
FIG. 2 is a schematic structural diagram of a pull-out box of a pull-out storage box in a slide-out state according to an embodiment of the present disclosure.

As shown in FIG. 2, in some embodiments of the present disclosure, the pull-out box and the pull-out frame are both of a rectangular structure, the two side beams 13 and the two rear beams 14 have a same structure, planes where the two pairs of first insertion grooves 15 are located are parallel to each other, the two pairs of second insertion grooves 16 are located in a same plane, and the plane where each pair of first insertion grooves 15 is located is orthogonal to the plane where the two pairs of second insertion grooves 16 are located.

Specifically, four support beams have a same structure, which ensures the symmetry of the support beams and is beneficial to the stability of the overall structure of the pull-out storage box and the uniformity of the manufacturing process. Both the first insertion grooves 15 and the second insertion grooves 16 are strip-shaped grooves. Their regular arrangement, combined with the insertion of four strip-shaped support beams, enables the pull-out frame to form a stable and evenly stressed rectangular frame structure, thus effectively preventing structural torsion caused by irregular arrangement.

Figure 3:
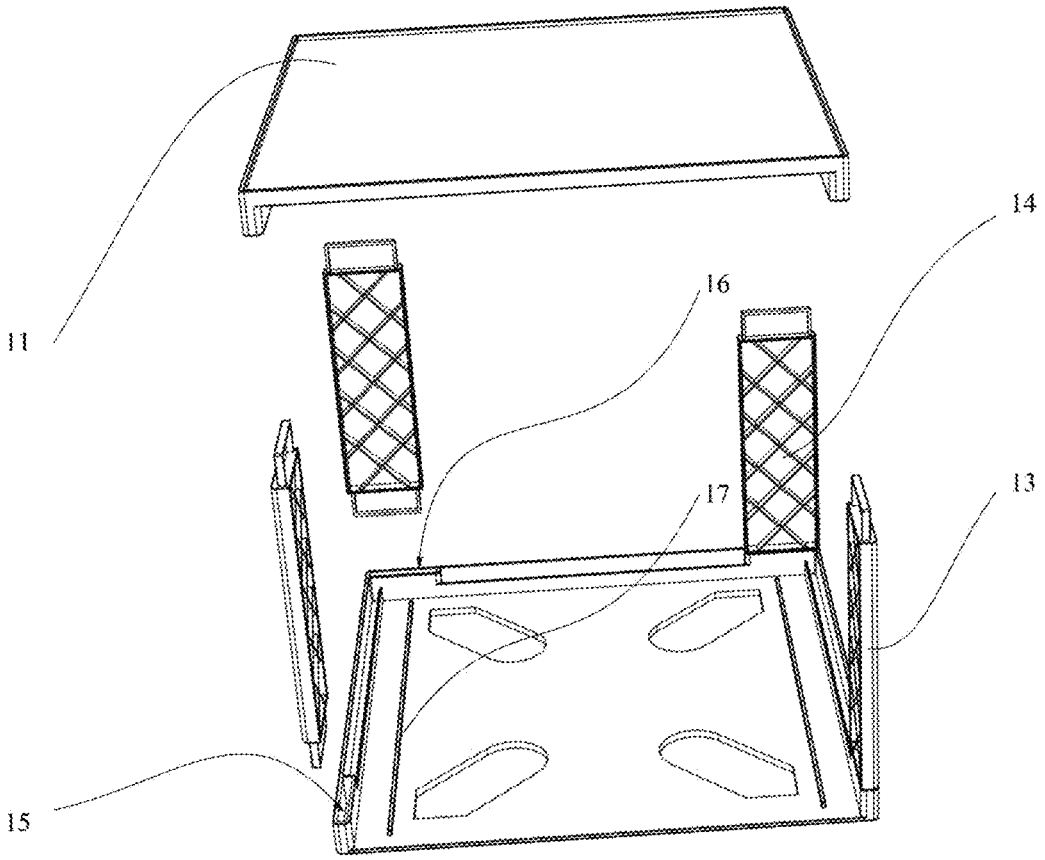
FIG. 3 is a first exploded structural view of a pull-out frame according to an embodiment of the present disclosure.

As shown in FIG. 3, in some embodiments of the present disclosure, two strip-shaped protruding portions 17 are separately disposed on an upper surface of the lower plate 12 along a sliding direction of the pull-out box, a length of the protruding portions 17 is slightly less than a length of the lower plate 12, and a height of the protruding portions 17 is slightly greater than a height of the lower plate 12.

Specifically, the protruding portions 17 create a certain gap between the pull-out box and the lower plate 12 to prevent the bottom plate 20 of the pull-out box from directly contacting the lower plate 12, thereby reducing friction and wear to a certain extent and extending its service life. The length of the protruding portions 17 is close to but slightly less than the overall length of the lower plate 12, which can provide maximum support for the pull-out box to ensure uniform and stable force on the pull-out box during use, and can prevent the protruding portions 17 from extending beyond an edge of the lower plate 12, thus maintaining the aesthetics and compactness of the overall structure of the pull-out storage box. The height of the protruding portions 17 is slightly greater than the height of the lower plate 12, enabling effective support for the pull-out box. However, the height of the protruding portions should be controlled within a reasonable range to avoid interference between the pull-out box and the pull-out frame due to excessive height, which would affect the sliding smoothness of the pull-out box.

Figure 4:
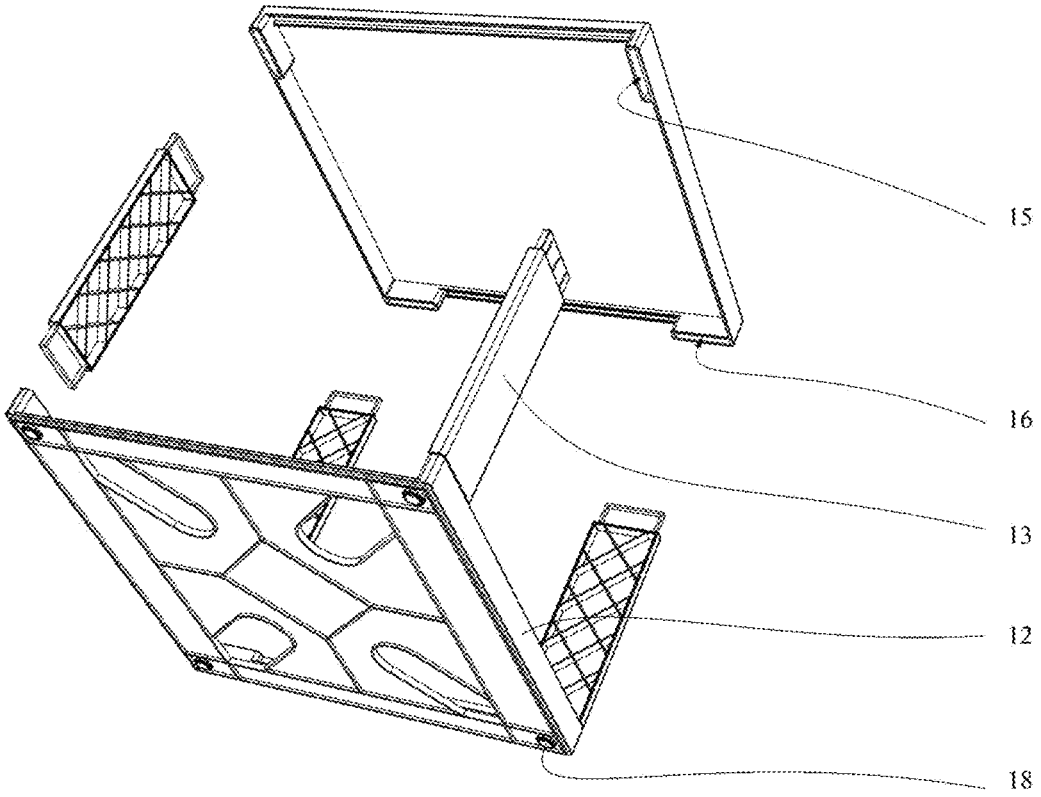
FIG. 4 is a second exploded structural view of a pull-out frame according to an embodiment of the present disclosure.

As shown in FIG. 4, in some embodiments of the present disclosure, mounting positions are respectively disposed at four corners of a lower surface of the lower plate 12, and a soft gasket 18 is disposed in each of the mounting positions and protrudes from the mounting position.

Specifically, the mounting positions are disposed at the four corners of the rectangular lower plate 12, and cooperate with the slightly protruding soft gaskets 18 to jointly form four foot pads. This ensures that the pull-out frame bears a load through definite support points, thereby improving uniform load distribution and the overall support effect. The soft gaskets 18 mainly serve a cushioning and protective function, and can not only effectively prevent damage and noise caused by direct contact between hard components, but also compensate for minor unevenness of a support surface with their flexibility, thereby further enhancing the stability of the product.

In some embodiments of the present disclosure, the mounting positions and the soft gaskets 18 are both of a circular structure.

Specifically, the circular structure is less prone to mounting errors due to direction issues, and the force is distributed more uniformly, thus effectively avoiding stress concentration and reducing the risk of local damage.

Figure 5:
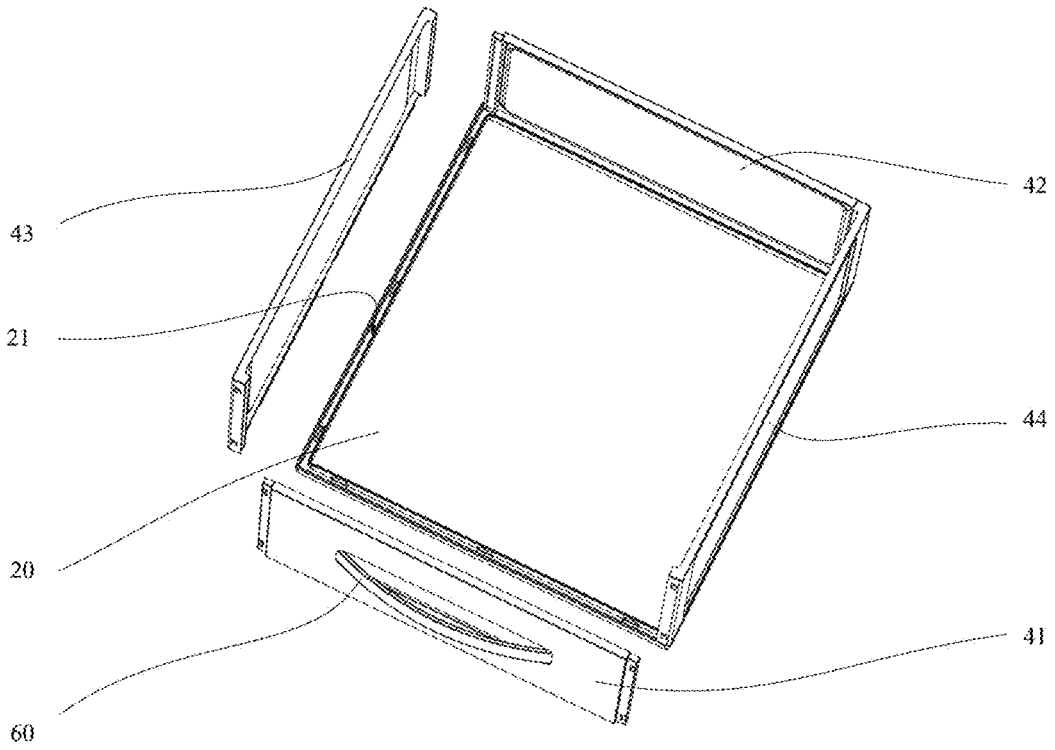
FIG. 5 is an exploded structural view of a pull-out box according to an embodiment of the present disclosure.
Figure 6:
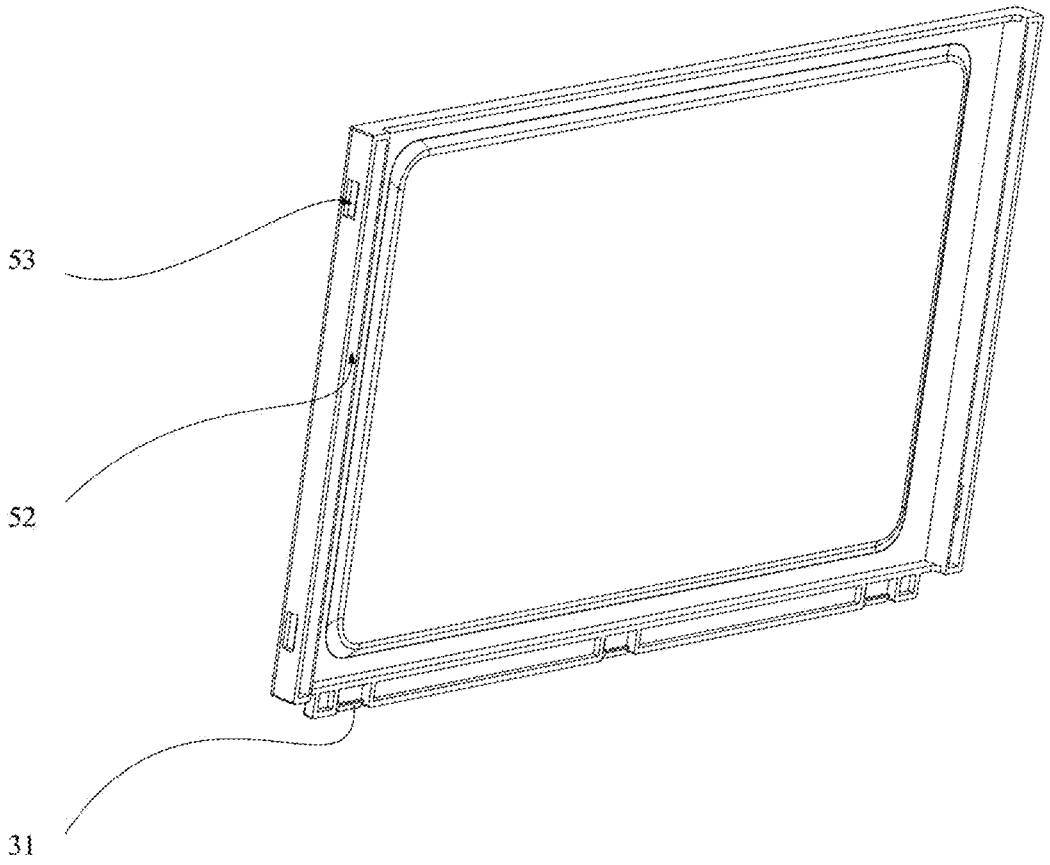
FIG. 6 is a schematic structural diagram of a left plate according to an embodiment of the present disclosure.
Figure 7:
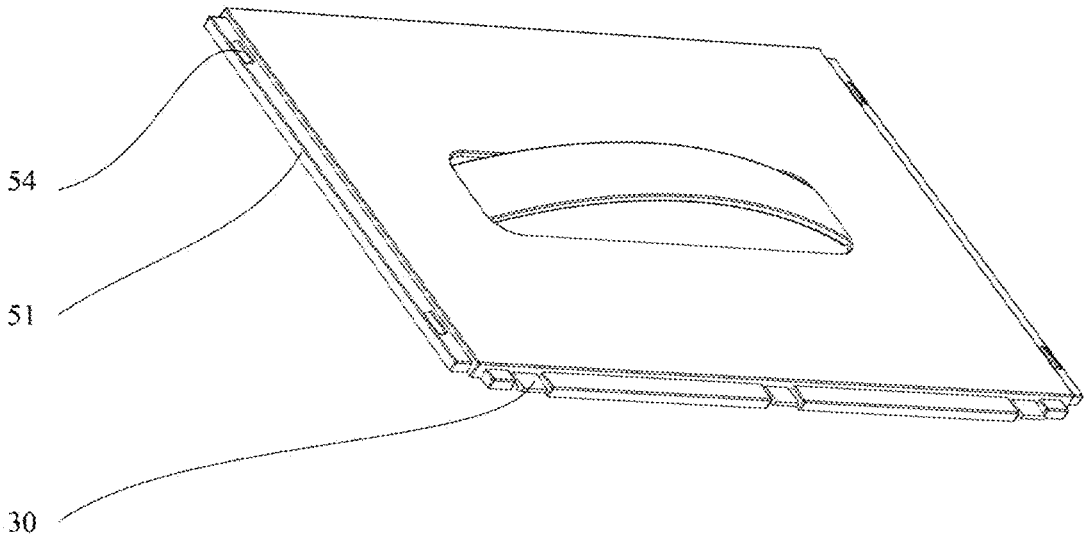
FIG. 7 is a schematic structural diagram of a front plate according to an embodiment of the present disclosure.
Figure 8:
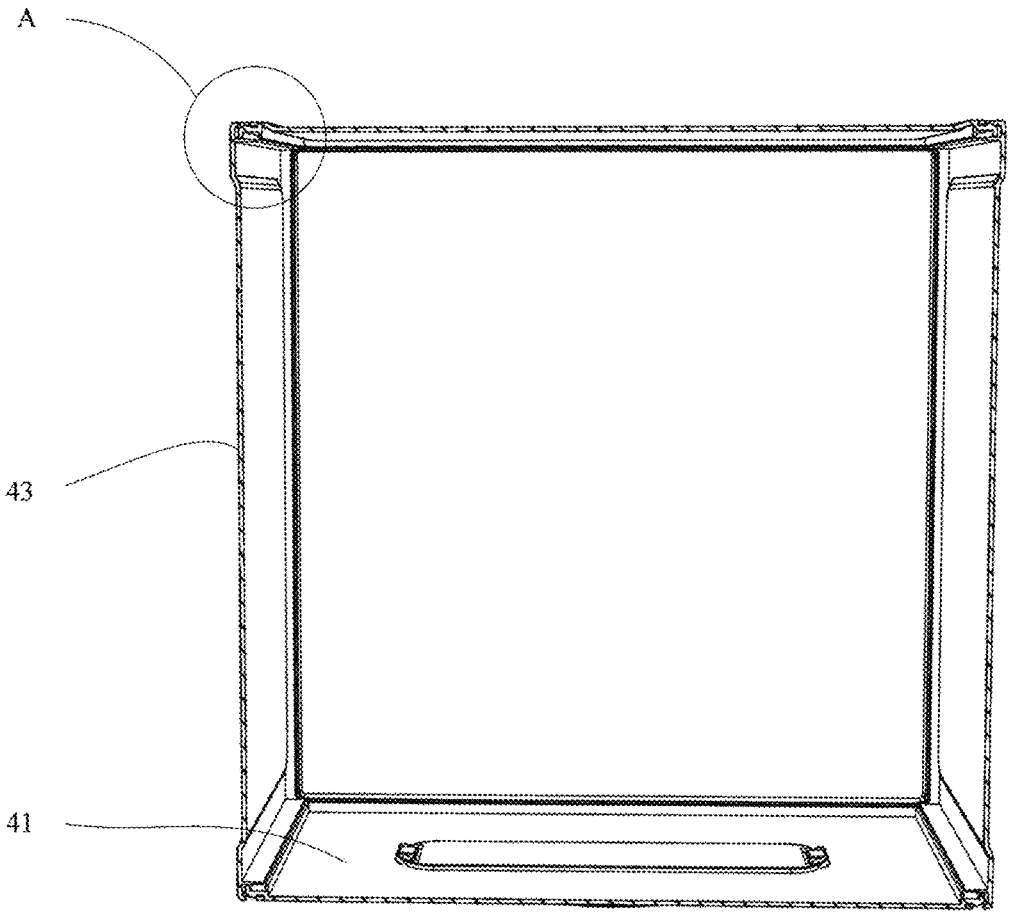
FIG. 8 is a transverse cross-sectional view of a pull-out storage box according to an embodiment of the present disclosure.
Figure 9:
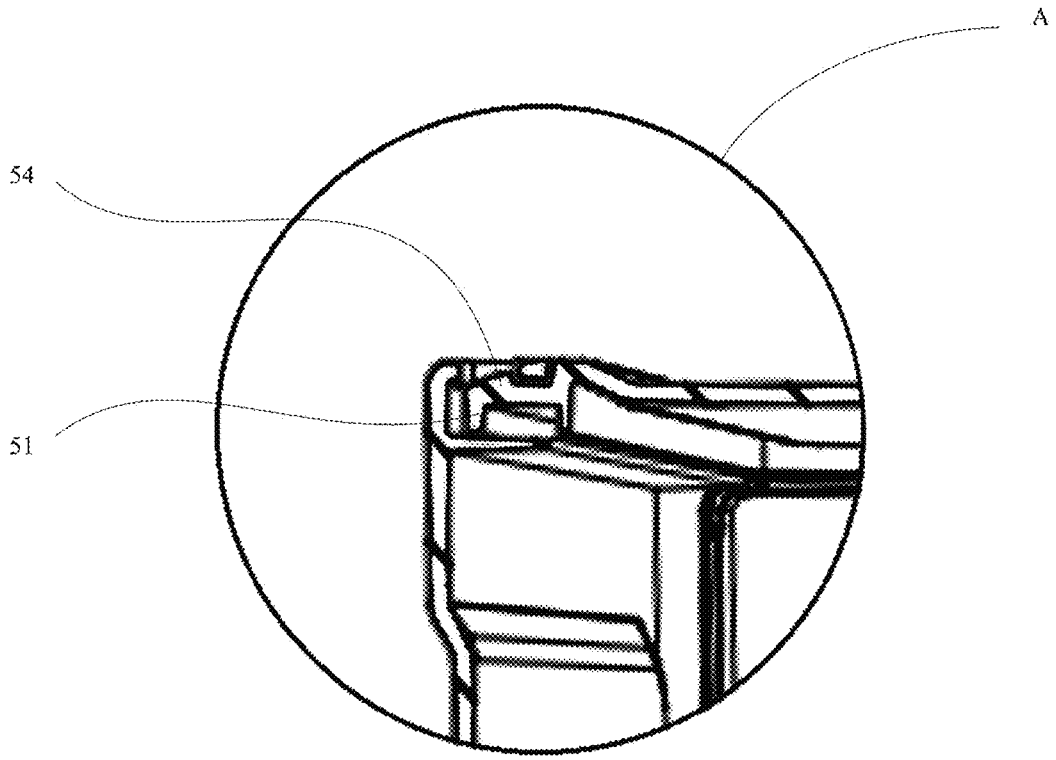
FIG. 9 is a schematic structural diagram of a local part A in FIG. 8.
Figure 10:
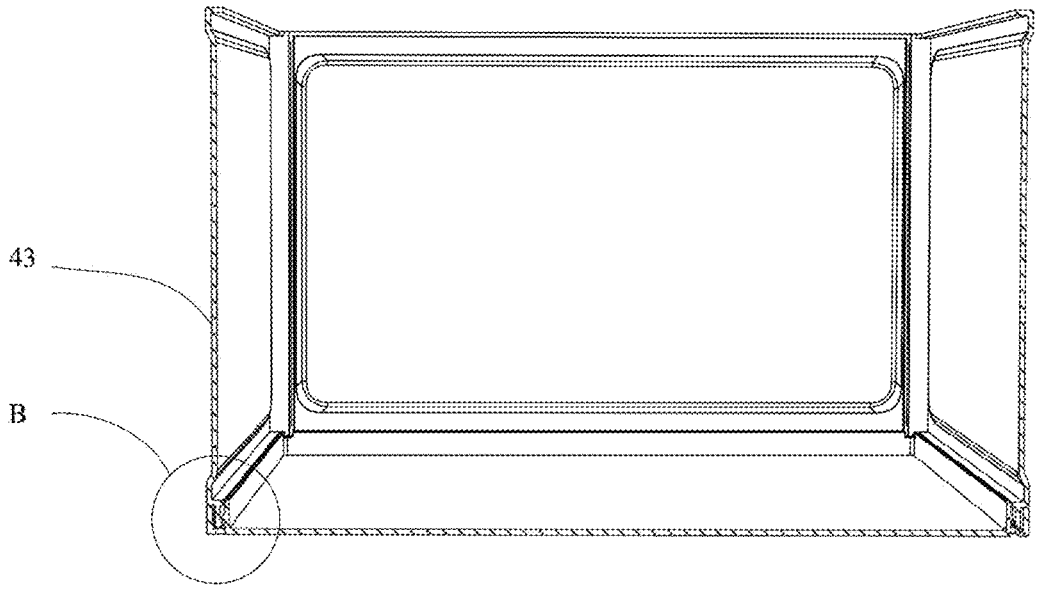
FIG. 10 is a longitudinal cross-sectional view of a pull-out storage box according to an embodiment of the present disclosure.
Figure 11:
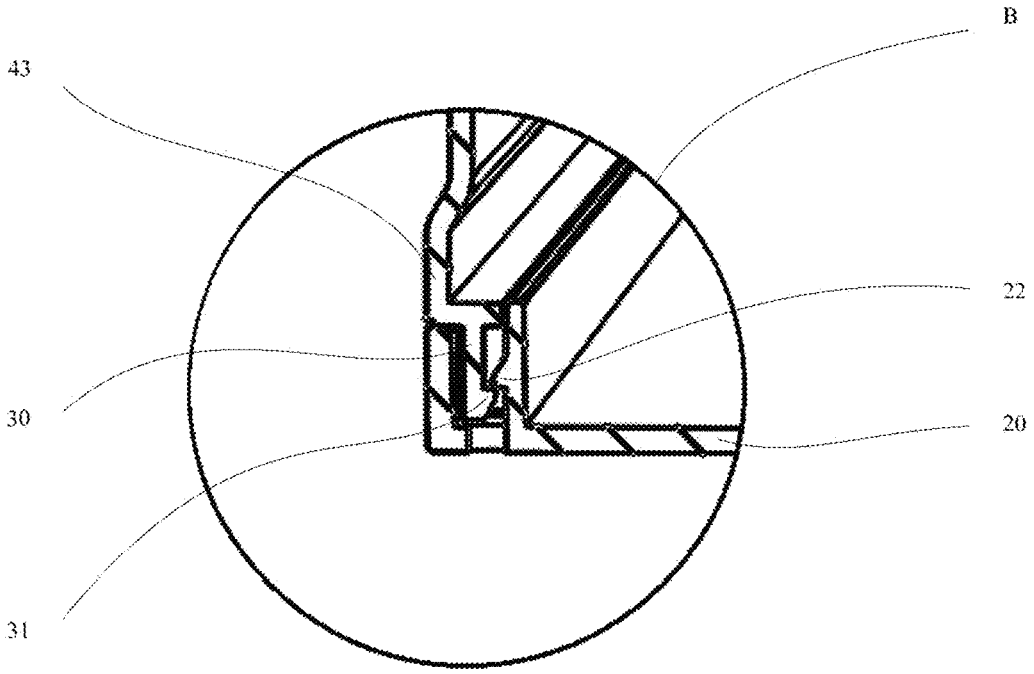
FIG. 11 is a schematic structural diagram of a local part B in FIG. 10.

As shown in FIG. 5, in some embodiments of the present disclosure, the pull-out box includes a bottom plate 20 and a side portion, where the bottom plate 20 is of a planar structure, the side portion is of a vertically through structure, and the bottom plate 20 and the side portion are connected by insertion fit and enclose to form an integrated box body with an upward opening.

Specifically, the bottom plate 20 has a planar structure and mainly functions to support and connect the side portion. The side portion is a structure surrounding the bottom plate 20 and is vertically through. Matching insertion structures (such as clamping grooves or bosses) are disposed between the bottom plate 20 and the side portion, such that the bottom plate and the side portion can be stably connected by insertion fit and jointly enclose to form an integrated box body. An opening of the integrated box body faces upward, thereby facilitating access of items and meeting usage requirements of the pull-out storage box.

As shown in FIGS. 6-11, in some embodiments of the present disclosure, an edge of the bottom plate 20 is provided with a third insertion groove 21 having an upward opening; a side wall of the third insertion groove 21 protrudes from an upper surface of the bottom plate 20 and is provided with a first wedge member 22; a spacing between a wedge surface of the first wedge member 22 and the side wall of the third insertion groove 21 increases gradually from top to bottom along a direction away from the third insertion groove 21, starting from a position connected to the side wall of the third insertion groove 21; a flat surface of the first wedge member 22 is perpendicular to the side wall of the third insertion groove 21 and connected to a lower part of the wedge surface of the first wedge member 22; a bottom surface of the side portion is provided with an insertion strip 30 matching the third insertion groove 21; an upper end of the insertion strip 30 is not flush with a left end and/or a right end of the bottom surface of the side portion, such that at least one of the left end and the right end of the bottom surface of the side portion forms a projecting portion; a position of a side wall of a lower end of the insertion strip 30 corresponding to the first wedge member 22 is provided with a second wedge member 31; a spacing between a wedge surface of the second wedge member 31 and the side wall of the lower end of the insertion strip 30 increases gradually from bottom to top along a direction away from the insertion strip 30, starting from a position connected to the insertion strip 30; a flat surface of the second wedge member 31 is perpendicular to a side wall of the insertion strip 30 and connected to an upper part of the wedge surface of the second wedge member 31;

when the insertion strip 30 on the side portion is inserted into the third insertion groove 21 from the opening of the third insertion groove 21 in the bottom plate 20, the wedge surface of the second wedge member 31 slides along the wedge surface of the first wedge member 22 until the flat surface of the second wedge member 31 is limited by the flat surface of the first wedge member 22; in addition, the projecting portion of the bottom surface of the side portion is blocked by the side wall of the third insertion groove 21, such that the side portion and the bottom plate 20 closely enclose to form an integrated box body.

Specifically, the edge of the bottom plate 20 is provided with a third insertion groove 21, and the side wall of the third insertion groove 21 is higher than the upper surface of the bottom plate 20 to form a three-dimensional structure, which facilitates insertion and engagement of the insertion strip 30 on the side portion. The side wall of the third insertion groove 21 is provided with a first wedge member 22, and the wedge surface of the first wedge member gradually moves away from the side wall of the third insertion groove 21 from top to bottom, so as to facilitate sliding fit when the insertion strip 30 on the side portion is inserted. The flat surface of the first wedge member 22 is located at the lower part of the wedge surface of the first wedge member 22 and functions to limit the insertion strip 30. The bottom surface of the side portion is provided with an insertion strip 30 matching the third insertion groove 21, where the insertion strip 30 is a projecting portion for being inserted into the third insertion groove 21 in the bottom plate 20. The upper end of the insertion strip 30 is not flush with the left end and/or the right end of the bottom surface of the side portion, thereby forming a projecting portion. The projecting portion is configured to establish a blocking relationship with the side wall of the third insertion groove 21 (specifically, an upper edge of the side wall of the third insertion groove 21), preventing the side portion from further moving downward along a direction of the third insertion groove 21. The lower end of the insertion strip 30 is further provided with a second wedge member 31 matching the first wedge member 22, where an inclination direction of the wedge surface of the second wedge member 31 is opposite to an inclination direction of the wedge surface of the first wedge member 22, so as to facilitate sliding fit during insertion. The flat surface of the second wedge member 31 is located at the upper part of the wedge surface of the second wedge member 31 and can cooperate with the flat surface of the first wedge member 22 to limit the second wedge member 31. When the insertion strip 30 on the side portion is inserted into the third insertion groove 21 from the opening of the third insertion groove 21 in the bottom plate 20, the wedge surface of the second wedge member 31 slides along the wedge surface of the first wedge member 22 and shifts slightly outward relative to its initial position at the same time. Through the cooperation between the two wedge surfaces, the flat surface of the second wedge member 31 is guided to the lower part of the flat surface of the first wedge member 22 and limited by it. In this case, the second wedge member 31 is in a reset state. Subsequently, once the second wedge member 31 tends to move upward, it will be promptly blocked by the flat surface of the first wedge member 22. In addition, the projecting portion of the bottom surface of the side portion is also blocked by the side wall of the third insertion groove 21 to prevent the side portion from further moving downward. In this way, the side portion is effectively prevented from moving up and down relative to the bottom plate 20, such that the side portion and the bottom plate can closely enclose to form an integrated box body with a stable structure. According to the pull-out box, the structure is compact and firm, automatic fastening and locking between the bottom plate 20 and the side portion during assembly are achieved through a vertically matched wedge-fit relationship and a blocking mechanism, the connection strength is effectively improved, and the durability and user experience of the product are enhanced. The pull-out box is suitable for being made of a plastic material with a certain elasticity. This material can not only satisfy the overall rigidity requirement of the product, but also ensure reliable shifting and resetting of the second wedge member 31, thereby meeting diverse application requirements.

During assembly of the pull-out box, only the insertion strip 30 on the side portion needs to be inserted into the third insertion groove 21 in the bottom plate 20 from top to bottom, such that the bottom plate 20 and the side portion can closely enclose to form an integrated box body, thereby completing the assembly. This process is easy to operate and can be quickly completed with just one downward insertion action. During insertion, the second wedge member 31 shifts slightly outward through wedge fit with the first wedge member 22 as the insertion strip 30 advances; and after the insertion strip 30 is pushed into place, a force-bearing state of the wedge fit is released, and the second wedge member 31 retracts inward to return to its original position and is limited by the first wedge member 22 to prevent upward movement. In addition, when the insertion strip 30 is pushed into place, due to a blocking relationship between an end of the side portion and the side wall of the third insertion groove 21, the side portion is blocked by the third insertion groove 21 to effectively prevent further downward movement. Through this vertical bidirectional locking structure, the connection stability and firmness between the bottom plate 20 and the side portion can be significantly improved, thereby effectively extending the service life of the pull-out box, and optimizing the overall user experience.

In some embodiments of the present disclosure, the side portion includes a front plate 41 and a rear plate 42 arranged symmetrically front and back, and a left plate 43 and a right plate 44 arranged symmetrically left and right, where front and rear ends of the left plate 43 and the right plate 44 are each provided with a strip-shaped clamping groove 52, and left and right ends of the front plate 41 and the rear plate 42 are each provided with a strip-shaped clamping strip 51 matching the strip-shaped clamping groove 52; and when all the strip-shaped clamping strips 51 are inserted into the corresponding strip-shaped clamping grooves 52 from openings of the corresponding strip-shaped clamping grooves 52, the front plate 41, the left plate 43, the rear plate 42, and the right plate 44 are sequentially connected and enclose to form a vertically through rectangular structure.

Specifically, the side portion is assembled from four plates by means of insertion. By inserting the strip-shaped clamping strips 51 of the front plate 41 and the rear plate 42 into the openings of the strip-shaped clamping grooves 52 of the left plate 43 and the right plate 44, the four plates can be sequentially connected to form a vertically through rectangular structure. The fit between the strip-shaped clamping grooves 52 and the strip-shaped clamping strips 51 not only provides a firm connection but also facilitates disassembly, which is beneficial for subsequent maintenance or replacement. It should be noted that, in this embodiment, the front and rear ends of the left plate 43 and the right plate 44 are each provided with a strip-shaped clamping groove 52, and the left and right ends of the front plate 41 and the rear plate 42 are each provided with a strip-shaped clamping strip 51. Certainly, the front and rear ends of the left plate 43 and the right plate 44 can be each provided with a strip-shaped clamping strip 51, and the left and right ends of the front plate 41 and the rear plate 42 can be each provided with a strip-shaped clamping groove 52, such that the two configurations are interchangeable. In practical applications, the appropriate configuration can be selected according to specific structural requirements and assembly convenience, thereby achieving overall structural flexibility and diversity.

In some embodiments of the present disclosure, a side wall of the strip-shaped clamping groove 52 is provided with a through hole 53, and a side wall of the strip-shaped clamping strip 51 is provided with a wedge block 54 matching the through hole 53; and when the strip-shaped clamping strip 51 is inserted into the corresponding strip-shaped clamping groove 52 from the opening of the corresponding strip-shaped clamping groove 52, the wedge block 54 extends into the through hole 53 and a flat surface of the wedge block 54 is limited by a side edge of the through hole 53.

Specifically, the side wall of the strip-shaped clamping groove 52 is provided with a rectangular through hole 53, where the through hole 53 provides an insertion space for the wedge block 54 on the side wall of the strip-shaped clamping strip 51. The wedge block 54 is a protruding structure with a flat surface and a wedge surface (also known as an inclined surface), and matches the through hole 53 in shape. When the strip-shaped clamping strip 51 is inserted from the opening of the strip-shaped clamping groove 52, the wedge block 54 smoothly extends into the through hole 53, and its flat surface closely abuts against the left side edge or the right side edge of the through hole 53 to form a lateral mechanical limit, which effectively prevents the strip-shaped clamping strip 51 from left-right shaking or shifting in the strip-shaped clamping groove 52. In the pull-out box, the strip-shaped clamping strips 51 are inserted into the strip-shaped clamping grooves 52 to achieve a stable connection of a first layer and form a simple and efficient insertion structure. Then, the wedge blocks 54 accurately cooperate with the through holes 53 for limiting to achieve a mechanical limit of a second layer and further improve the fit accuracy between the strip-shaped clamping strips 51 and the strip-shaped clamping grooves 52 and the stability of the overall structure. This dual-connection and limiting structure not only effectively restrains the left-right relative movement between side plates (including a front plate 41, a rear plate 42, a left plate 43, and a right plate 44), but also greatly enhances the overall structural reliability of the pull-out box, meeting the requirements for high-stability applications.

In some embodiments of the present disclosure, the front plate 41 is provided with a handle 60.

Specifically, the provision of the handle 60 facilitates the user to pull the front plate 41, thus significantly improving the convenience of using the pull-out box, and making it particularly suitable for scenarios where the front plate 41 needs to be frequently opened and closed.

In the pull-out storage box according to the present disclosure, a stable assembly structure is formed by arranging the support points on the sides and the rear end of the pull-out frame. According to the pull-out box, a firm connection of the integrated box body is achieved through a vertical bidirectional locking structure between the side portion and the bottom plate 20. The overall structure of the product balances connection firmness, structural rigidity, and lightweight design, fully meeting the storage requirements in daily life. It is particularly suitable for high-load and high-frequency usage scenarios, with obvious structural and usage advantages.

It should be noted that the technical solutions among the various embodiments may be combined with one another, but must be based on the implementation by those of ordinary skill in the art. When the combination of the technical solutions is contradictory or may not be implemented, it should be considered that such combination of the technical solutions does not exist and is not within the scope of protection of the present disclosure.

The above descriptions are merely some or preferred embodiments of the present disclosure, and neither the text nor the drawings should be construed to limit the scope of protection of the present disclosure. Any equivalent structural changes made using the contents of the specification and drawings of the present disclosure under an overall concept of the present disclosure, directly/indirectly applied in other related technical fields, are included within the scope of protection of the present disclosure.

What is claimed is:

1. A pull-out storage box, comprising a pull-out box and a pull-out frame, wherein the pull-out box is of a hollow structure and has an upward opening; the pull-out frame comprises an upper plate, a lower plate, and a plurality of support beams comprising two side beams and two rear beams; the upper plate and the lower plate are provided with two pairs of first insertion grooves, each pair of first insertion grooves including one first insertion groove on the upper plate and one opposing first insertion groove on the lower plate, one of the two pairs of first insertion grooves being disposed at left ends of the upper plate and the lower plate, and another of the two pairs of first insertion grooves being disposed at right ends of the upper plate and the lower plate; and the upper plate and the lower plate are provided with two separated pairs of second insertion grooves at rear ends of the upper plate and the lower plate, each pair of second insertion grooves including one second insertion groove on the upper plate and one opposing second insertion groove on the lower plate;

when an upper end and a lower end of each of the side beams are respectively inserted into the corresponding pair of first insertion grooves, and an upper end and a lower end of each of the rear beams are respectively inserted into the corresponding pair of second insertion grooves, the pull-out frame forms an integrated frame structure; and the pull-out box is located on the lower plate and capable of sliding into or out of the frame structure;

wherein the pull-out box and the pull-out frame are both of a rectangular structure, the two side beams and the two rear beams are four support beams that all have the same structure, planes where the two pairs of first insertion grooves are located are parallel to each other, the two pairs of second insertion grooves are located in a same plane, and the plane where each pair of first insertion grooves is located is orthogonal to the plane where the two pairs of second insertion grooves are located;

wherein the pull-out box comprises a bottom plate and a side portion, the bottom plate is of a planar structure, the side portion is of a vertically through structure, and the bottom plate and the side portion are connected by insertion fit and enclose to form the pull-out box as an integrated box body with the upward opening of the pull-out box;

wherein the side portion comprises a front plate and a rear plate arranged symmetrically front and back, and a left plate and a right plate arranged symmetrically left and right; front and rear ends of the left plate and the right plate are each provided with a strip-shaped clamping groove, and left and right ends of the front plate and the rear plate are each provided with a strip-shaped clamping strip matching the strip-shaped clamping groove; and when all the strip-shaped clamping strips are inserted into the corresponding strip-shaped clamping grooves from openings of the corresponding strip-shaped clamping grooves, the front plate, the left plate, the rear plate, and the right plate are sequentially connected and enclose to form a vertically through rectangular structure;

wherein a side wall of each strip-shaped clamping groove is provided with a through hole, and a side wall of each strip-shaped clamping strip is provided with a wedge block matching the through hole of the corresponding strip-shaped clamping groove; and when each strip-shaped clamping strip is inserted into the corresponding strip-shaped clamping groove from the opening of the corresponding strip-shaped clamping groove, the corresponding wedge block extends into the corresponding through hole and a flat surface of the corresponding wedge block is limited by a side edge of the corresponding through hole.

2. The pull-out storage box according to claim 1, wherein two strip-shaped protruding portions are separately disposed on an upper surface of the lower plate along a sliding direction of the pull-out box, a length of the protruding portions is slightly less than a length of the lower plate, and a height of the protruding portions is slightly greater than a height of the lower plate.

3. The pull-out storage box according to claim 1, wherein mounting positions are respectively disposed at four corners of a lower surface of the lower plate, and a soft gasket is disposed in each of the mounting positions and protrudes from the mounting position.

4. The pull-out storage box according to claim 3, wherein the mounting positions and the soft gaskets are both of a circular structure.

5. The pull-out storage box according to claim 1, wherein an edge of the bottom plate is provided with a third insertion groove having an upward opening; a side wall of the third insertion groove protrudes from an upper surface of the bottom plate and is provided with a first wedge member; a spacing between a wedge surface of the first wedge member and the side wall of the third insertion groove increases gradually from top to bottom, such that the wedge surface of the first wedge member gradually moves away from the side wall of the third insertion groove from top to bottom; a flat surface of the first wedge member is perpendicular to the side wall of the third insertion groove and connected to a lower part of the wedge surface of the first wedge member; a bottom surface of the side portion is provided with an insertion strip matching the third insertion groove; at least one of a left end and a right end of the bottom surface of the side portion is adjacent to the insertion strip and is configured to be blocked by an upper edge of the side wall of the third insertion groove to prevent the side portion from further moving downward along a direction of the third insertion groove; the second wedge member is provided on a side wall of a lower end of the insertion strip at a position corresponding to the first wedge member; a spacing between a wedge surface of the second wedge member and the side wall of the lower end of the insertion strip increases gradually from bottom to top, such that the wedge surface of the second wedge member gradually moves away from the side wall of the lower end of the insertion strip from bottom to top; a flat surface of the second wedge member is perpendicular to a side wall of the insertion strip and connected to an upper part of the wedge surface of the second wedge member;

when the insertion strip on the side portion is inserted into the third insertion groove from the opening of the third insertion groove in the bottom plate, the wedge surface of the second wedge member slides along the wedge surface of the first wedge member until the flat surface of the second wedge member is limited by the flat surface of the first wedge member; and the at least one of the left end and the right end of the bottom surface of the side portion is blocked by the upper edge of the side wall of the third insertion groove, such that the side portion and the bottom plate closely enclose to form an integrated box body.

6. The pull-out storage box according to claim 1, wherein the front plate is provided with a handle.

* * * * *